US010483683B2

(12) United States Patent
Johnescu et al.

(10) Patent No.: US 10,483,683 B2
(45) Date of Patent: Nov. 19, 2019

(54) ORGANIZER FOR ELECTRICAL CONNECTOR

(71) Applicant: FCI USA LLC, Etters, PA (US)

(72) Inventors: Douglas M. Johnescu, York, PA (US); Stuart C. Stoner, Etters, PA (US); Charles Copper, Hummelstown, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/532,429

(22) PCT Filed: Dec. 1, 2015

(86) PCT No.: PCT/US2015/063122

§ 371 (c)(1),
(2) Date: Jun. 1, 2017

(87) PCT Pub. No.: WO2016/089827

PCT Pub. Date: Jun. 9, 2016

(65) Prior Publication Data

US 2017/0271808 A1 Sep. 21, 2017

Related U.S. Application Data

(60) Provisional application No. 62/086,129, filed on Dec. 1, 2014.

(51) Int. Cl.
*H01R 13/514* (2006.01)
*H01R 12/70* (2011.01)
(Continued)

(52) U.S. Cl.
CPC ..... *H01R 13/514* (2013.01); *H01R 12/7005* (2013.01); *H01R 12/724* (2013.01);
(Continued)

(58) Field of Classification Search
CPC .... H01R 24/60; H01R 13/506; H01R 12/716; H01R 12/724; H01R 13/639;
(Continued)

(56) References Cited

U.S. PATENT DOCUMENTS 6,123,554 A 9/2000 Ortega et al.
6,361,374 B1 * 3/2002 Lloyd ..... H01R 13/518 439/607.12

(Continued)

FOREIGN PATENT DOCUMENTS

CN 102356520 A 2/2012
CN 103296522 A 9/2013

(Continued)

OTHER PUBLICATIONS

International Search Report and Written Opinion for International Application No. PCT/US2015/063122 dated Mar. 25, 2016.

(Continued)

*Primary Examiner* — Truc T Nguyen
(74) *Attorney, Agent, or Firm* — Wolf, Greenfield & Sacks, P.C.

(57) ABSTRACT

Electrically insulative organizers configured to maintain alignment of leadframe assemblies in an electrical connector are disclosed, in one example, an organizer includes a stiffener wall and a projection that extends from the stiffener wall. The electrically insulative body is sized to be inserted into a channel defined by the leadframe assemblies. In another example, an organizer includes an electrically insulative organizer body and a plurality of divider walls that are supported by the organizer body and spaced from each other along a lateral direction so as to be positioned for insertion between adjacent leadframe assemblies.

20 Claims, 12 Drawing Sheets

(51) Int. Cl.
*H01R 12/72* (2011.01)
*H01R 13/6587* (2011.01)
*H01R 13/6586* (2011.01)

(52) U.S. Cl.
CPC ..... *H01R 12/727* (2013.01); *H01R 13/6586* (2013.01); *H01R 13/6587* (2013.01)

(58) Field of Classification Search
CPC .. H01R 13/6587; H01R 13/518; H01R 31/06; H01R 12/714; H01R 13/502; H01R 13/514; H01R 2103/00; H01R 2201/26; H01R 13/6582
See application file for complete search history.

(56) References Cited

U.S. PATENT DOCUMENTS

| | | | | |
|---|---|---|---|---|
| 8,475,209 | B1 | 7/2013 | Whiteman, Jr. et al. | |
| 2003/0119362 | A1* | 6/2003 | Nelson | H01R 13/518 439/607.07 |
| 2003/0186595 | A1* | 10/2003 | Provencher | H01R 13/6587 439/701 |
| 2005/0003707 | A1* | 1/2005 | Wu | H01R 13/514 439/579 |
| 2006/0068640 | A1* | 3/2006 | Gailus | H01R 13/719 439/607.08 |
| 2006/0166528 | A1 | 7/2006 | Hull et al. | |
| 2009/0068887 | A1 | 3/2009 | Ito | |
| 2009/0111298 | A1 | 4/2009 | Stoner et al. | |
| 2009/0176400 | A1* | 7/2009 | Davis | H01R 13/506 439/352 |
| 2010/0144201 | A1* | 6/2010 | Defibaugh | H01R 13/514 439/607.05 |
| 2010/0144203 | A1* | 6/2010 | Glover | H01R 13/514 439/607.07 |
| 2011/0117781 | A1* | 5/2011 | Stoner | H01R 13/6587 439/607.01 |
| 2013/0273756 | A1* | 10/2013 | Stoner | H01R 13/658 439/108 |
| 2013/0273781 | A1* | 10/2013 | Buck | H01R 13/516 439/626 |
| 2014/0335707 | A1 | 11/2014 | Johnescu et al. | |
| 2015/0249296 | A1* | 9/2015 | Yu | H01R 13/6587 439/676 |
| 2016/0006151 | A1* | 1/2016 | Liu | H01R 12/585 439/78 |
| 2016/0322760 | A1* | 11/2016 | Long | H01R 13/6587 |

FOREIGN PATENT DOCUMENTS

| | | | |
|---|---|---|---|
| CN | 205985490 | U | 2/2017 |
| JP | 2001-313112 | A | 11/2001 |
| TW | 201106541 | A | 2/2011 |

OTHER PUBLICATIONS

International Preliminary Report on Patentability for International Application No. PCT/US2015/063122 dated Jun. 15, 2017.
Chinese Office Action for Chinese Application No. 201510864781.3 dated Nov. 2, 2018.
Taiwanese Communication for Application No. TW 104140282 dated Jun. 24, 2019.
PCT/US2015/063122, Mar. 25, 2016, International Search Report and Written Opinion.
PCT/US2015/063122, Jun. 15, 2017, International Preliminary Report on Patentability.
CN 201510864781.3, Nov. 2, 2018, Office Action.
TW 104140282, Jun. 24, 2019, Taiwanese Communication.

* cited by examiner

ORGANIZER FOR ELECTRICAL CONNECTOR

RELATED APPLICATIONS

This application is the U.S. National Stage of and claims priority to International Patent Application Number PCT/US2015/063122, filed Dec. 1, 2015, entitled "ORGANIZER FOR ELECTRICAL CONNECTOR," which claims priority to and the benefit of U.S. Provisional Patent Application No. 62/086,129, filed Dec. 1, 2014, entitled "ORGANIZER FOR ELECTRICAL CONNECTOR," each of which is hereby incorporated herein by reference in their entireties.

BACKGROUND

U.S. Patent Application Publication No. 2013/0273781 A1, published Oct. 17, 2013, discloses an electrical connector including a connector housing and a plurality of leadframe assemblies supported by the connector housing. U.S. Patent Application Publication No. 2013/0273781 A1, published Oct. 17, 2013, is hereby incorporated by reference as if set forth in its entirety herein. As illustrated in FIG. 1, and as disclosed in U.S. Patent Application Publication No. 2013/0273781 A1, each leadframe assembly 20 includes a leadframe housing 22, a plurality of electrical signal contacts 24 supported by the leadframe housing 22, and an electrically conductive ground plate 26 supported by the leadframe housing 22. The ground plate 26 defines a plurality of ground mating ends 28 and ground mounting ends 30. Alternatively, the ground mating ends 28 and ground mounting ends 30 can be defined respective pluralities of individual ground contacts. The ground mating ends 28 are aligned with mating ends 32 of the respective electrical signal contacts 24 of the leadframe assembly 20 along a transverse direction and the ground mounting ends 30 are aligned with mounting ends 34 of the electrical signal contacts 24 of the leadframe assembly 20 along a longitudinal direction L that is perpendicular to the transverse direction T. The longitudinal direction L can define a column direction at the mounting interface of the electrical connector. The leadframe assemblies 20 are spaced from each other along a row direction, which is defined by a lateral direction A that is perpendicular to each of the longitudinal direction L and the transverse direction T. The leadframe housing 22 can be overmolded onto the electrical signal contacts 24 so as to define an insert molded leadframe assembly (IMLA). The ground plate 26 can be embossed so as to define a plurality of ribs 36 that extend between respective ones of the ground mounting ends and the ground mating ends. It is desired to maintain alignment of the leadframe assemblies 20 with respect to each other, such that the all mounting ends 34 and 30 are aligned with predetermined mounting locations of an underlying substrate to which the electrical connector is configured to be mounted. In one example, the mounting ends can be configured as press-fit tails, and the mounting locations can be configured as openings in the substrate that are configured to receive the press-fit tails.

SUMMARY

In one aspect of the present disclosure, an organizer is configured to maintain alignment of a plurality of leadframe assemblies of an electrical connector. The organizer can include an electrically insulative body that includes a stiffener wall and a projection that extends from the stiffener wall, wherein the electrically insulative body defines a plurality of grooves that extend into the projection and are spaced from each other along a first row. The electrically insulative body is sized to be inserted into a channel defined by the leadframe assemblies.

In another aspect of the present disclosure, an organizer is configured to maintain alignment of a plurality of leadframe assemblies of an electrical connector. The organizer can include an electrically insulative organizer body comprising a rear wall, a top wall that extends from an upper end of the rear wall in a forward direction that is oriented along a longitudinal direction. The organizer can further include a plurality of divider walls that are supported by the organizer body and spaced from each other along a lateral direction so as to be positioned for insertion between adjacent leadframe assemblies of an electrical connector. The lateral direction is perpendicular to the longitudinal direction Electrical connectors that include the organizer and associated methods are also disclosed.

DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and instrumentalities shown. Unless otherwise indicated, all dimensions shown in the drawings are in mm. In the drawings.

DETAILED DESCRIPTION

Figure 2A:
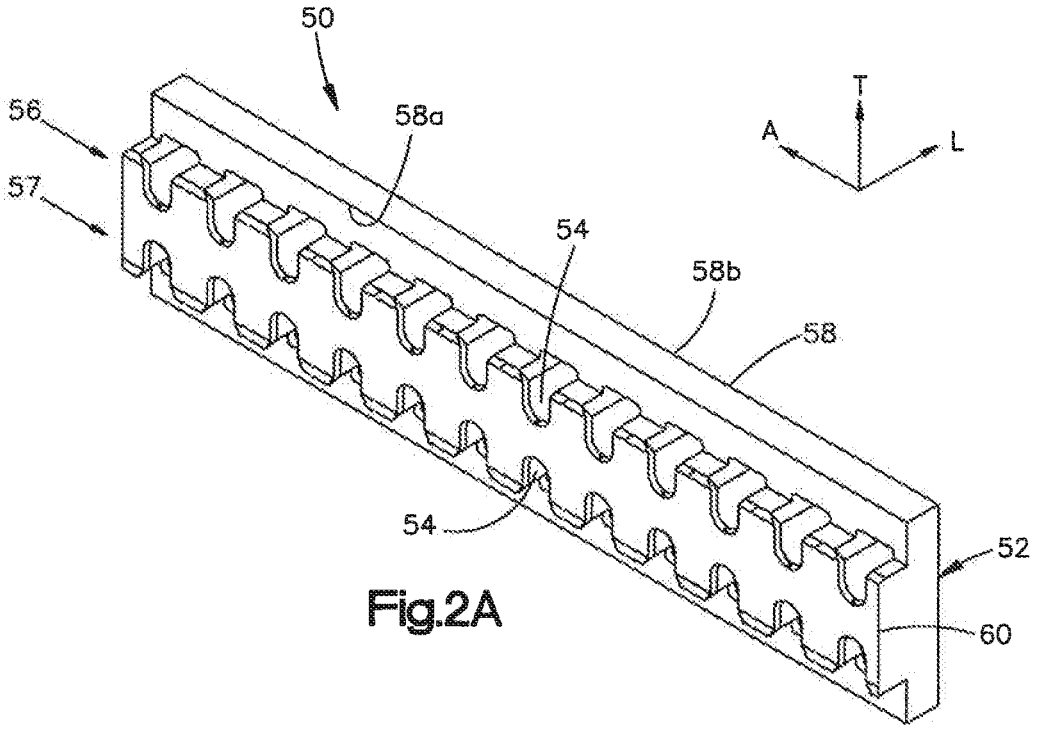
FIG. 2A is a perspective view of an organizer constructed in accordance with one embodiment.
Figure 2B:
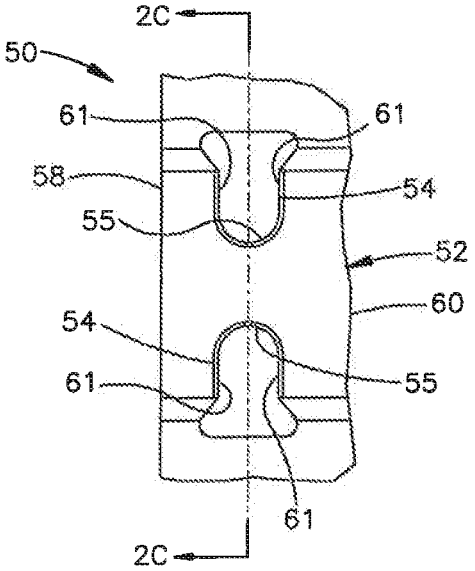
FIG. 2B is an enlarged front elevation view of the organizer illustrated in FIG. 2A.
Figure 2C:
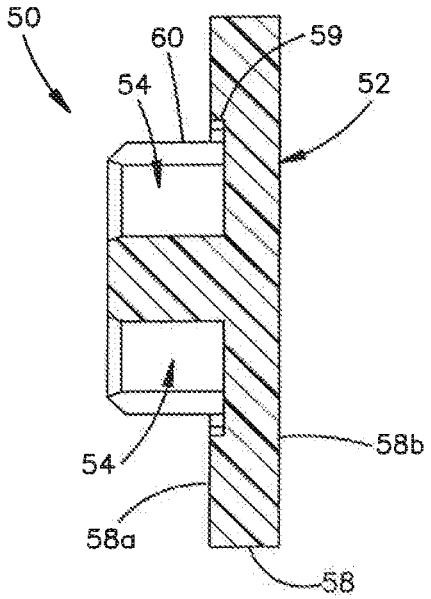
FIG. 2C is a sectional side elevation view of the portion of the organizer illustrated in FIG. 2B, taken along line 2C-2C.

Referring initially to FIGS. 2A-2C, an organizer 50 is configured to maintain alignment of a plurality of leadframe assemblies of an electrical connector. The organizer 50 can include an electrically insulative body 52. For instance, the electrically insulative body 52 can be made from a plastic. The body 52 can define a plurality of grooves 54 spaced from each other along a first row 56. Each of the grooves 54 is configured to receive a respective one of a plurality of leadframe assemblies 36 of an electrical connector 39 (see FIG. 3E). Because the organizer 50 is electrically insulative in one example, the organizer 50 will not conduct electrical current if placed in contact with the ground plate.

The body 52 includes a stiffener wall 58 and a projection 60 that extends out from the stiffener wall 58. The grooves 54 can extend into the projection 60, and can thus be defined by the projection 60. The stiffener wall 58 and the projection 60 can be monolithic with each other. Alternatively, the stiffener wall and the projection 60 can be separate from each other and attached to each other in any manner as desired. It should be appreciated that the stiffener wall can be electrically insulative. For instance, the stiffener wall 58 can be made of a plastic. Alternatively, for instance, if the stiffener wall 58 and the projection 60 are separate from each other and attached to each other, the stiffener wall 58 can be made of an electrically conductive material, such as metal, for instance, if the stiffener wall 58 is spaced from the ground plate in instances where the ground plate carries electrical current. The organizer 50 can further include a debris pocket 59 formed between the stiffener wall 58 and the projection 60.

The projection 60 can extend from the stiffener wall 58 in a forward direction that is oriented along a longitudinal direction L. In particular, the stiffener wall 58 defines a front surface 58*a* and a rear surface 58*b* that is opposite the front surface 58*a*. The front surface 58*a* is spaced from the rear surface 58*b* along in the forward direction. The projection can extend from the front surface 58*a* in the forward direction. The stiffener wall 58 can have a thickness along the longitudinal direction L that is between approximately 0.2 mm and approximately 2 mm. For instance, the thickness of the stiffener wall 58 can be between approximately 0.4 mm and approximately 1 mm. In one example, the thickness of the stiffener wall is approximately 0.6 mm. The stiffener wall 58 can be elongate in a lateral direction A that is perpendicular to the longitudinal direction L. The opposed surfaces 61 can be spaced from each other along the lateral direction A. The grooves 54 can extend through the projection 60 along the longitudinal direction L, and can terminate at the stiffener wall 58. The opposed surfaces 61 can be spaced from each other along the lateral direction A. Further, the opposed surfaces 61 can extend from the stiffener wall 58 along the forward direction. The grooves 54 can extend into the projection 60 along a transverse direction T that is perpendicular to both the longitudinal direction L and the lateral direction A. Each of the grooves 54 can terminate in the projection 60 at a base 55 that is connected between the opposed surfaces 61. The base 55 can define a rounded surface or alternatively shaped surface as desired. In one example, the base 55 can define a surface that is concave with respect to the corresponding groove 54.

The grooves 54 can be arranged in at least one row that is oriented along the lateral direction A. For instance, at least a plurality of the grooves 54 up to an entirety of the grooves 54 can be aligned with each other along a first row 56. Each of the grooves 54 of the first row can be sized and shaped to receive a complementary retention wall of respective ones of the leadframe assemblies 36 (see FIG. 3E). The electrically insulative body 52 can further include a second row 57 of grooves 54 that can extend into the projection 60 along the transverse direction T. For instance, the groves 54 of the first row 56 can extend into the projection 60 in a first direction that is oriented along the transverse direction T, and the grooves 54 of the second row 57 can extend into the projection 60 in a second direction that is opposite the first direction along the transverse direction T. Adjacent ones of the grooves 54 of the first row 56 can be equidistantly spaced from each other along the lateral direction A. Similarly, adjacent ones of the grooves 54 of the second row 57 can be equidistantly spaced from each other along the lateral direction A. Further still, at least one or more up to all of the grooves 54 of the first row 56 can be aligned with a respective one of the grooves 54 of the second row 57 along the transverse direction T.

Figure 3A:
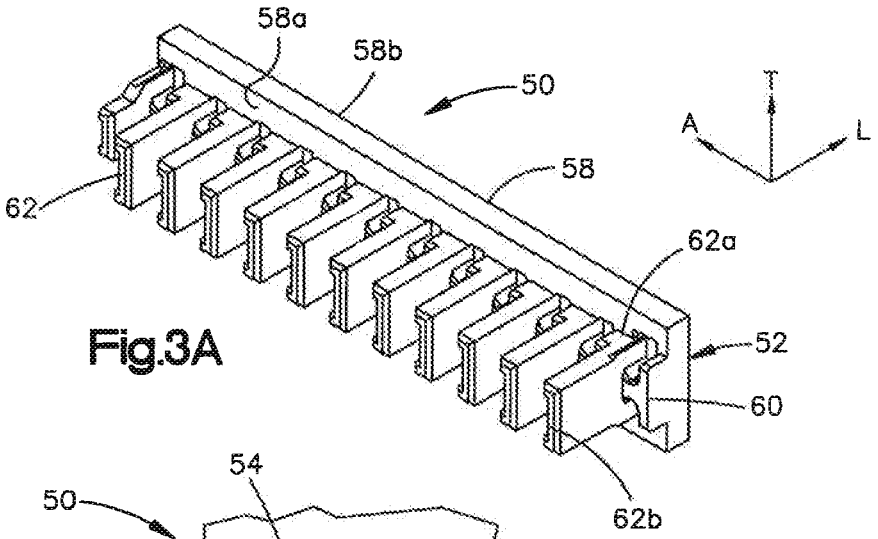
FIG. 3A is a perspective view of an organizer as illustrated in FIG. 2A, but further including a plurality of alignment arms.
Figure 3B:
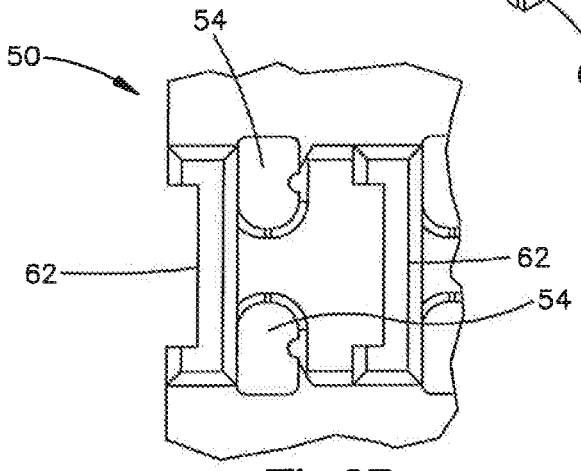
FIG. 3B is an enlarged front elevation view of the organizer illustrated in FIG. 3A.
Figure 3C:
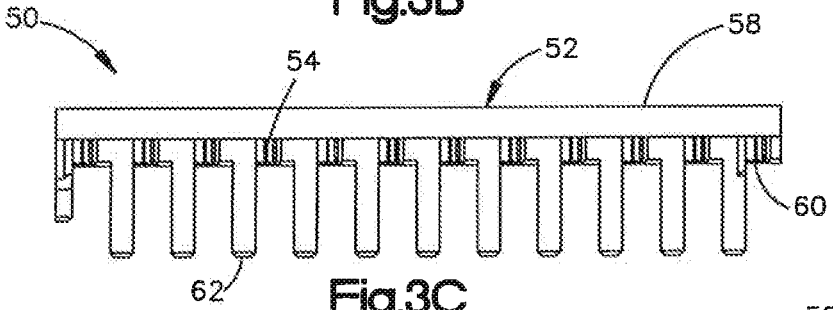
FIG. 3C is a top plan view of the organizer illustrated in FIG. 3A.
Figure 3D:
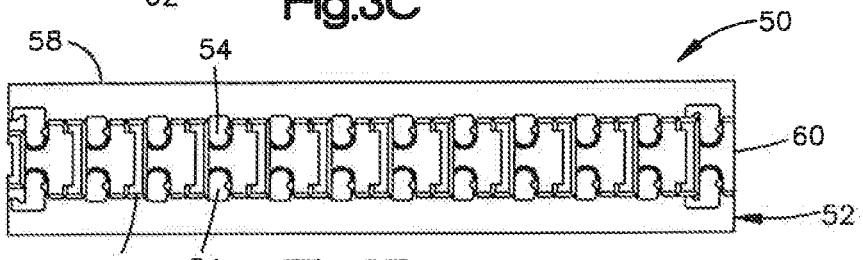
FIG. 3D is a front elevation view of the organizer illustrated in FIG. 3A.

Referring also to FIGS. 3A-3C, the organizer 50 can further include a plurality of electrically insulative alignment arms 62 that extend from the body 52 in the forward direction. For instance, each of the alignment arms 62 can extend from the projection 60 at a location adjacent at least one of the grooves 54. At least one, such as a plurality, of the alignment arms 62 can extend from the projection 60 at a location between adjacent ones of the grooves 54 that are adjacent each other along the lateral direction A. The alignment arms 62 can be monolithic with the body 52, and in particular monolithic with the projection 60. Alternatively, the alignment arms 62 can be separate from the body 52, and in particular separate from the projection 60, and configured to attach to the projection 60. The alignment arms 62 extend from the body 52 at respective proximal ends 62*a*, and can extend from the proximal ends 62*a* in the forward direction to respective distal ends 62*b*. The alignment arms 62 can have a substantially C-shaped cross-section with respect to a plane that is disposed between the proximal ends 62*a* and the distal ends 62*b* and is defined by the transverse direction T and the lateral direction A. In particular, each of the alignment arms 62 can include a primary wall 63*a* and secondary walls 63*b* and 63*c* that extend out from opposed ends of the primary wall 63*a*. The primary wall 63*a* can be elongate along the transverse direction T. The opposed ends can be opposite each other along the transverse direction T. The secondary walls 63*b* and 63*c* can be oriented perpendicular to the primary wall 63*a*, or can be angularly offset to the perpendicular direction while still having the substantially C-shaped cross-section.

At least a plurality of the alignment arms 62 up to an entirety of the alignment arms 62 can extend to a depth between approximately 2 mm and approximately 10 mm from the proximal end 62*a* to the distal end 62*b* along the longitudinal direction L. Thus, at least a plurality of the alignment arms 62 up to an entirety of the alignment arms 62 can extend to a depth between approximately 2 mm and approximately 10 mm with respect to the front surface 58*a* of the stiffener wall 58 along the longitudinal direction L. It can further be said that at least a plurality of the alignment arms 62 up to an entirety of the alignment arms 62 can extend to a depth between approximately 2 mm and approximately 10 mm from the body 52 along the longitudinal direction L. For instance, the depth can be between approximately 2 mm and approximately 6 mm. In one example, the depth can be approximately 3.9 mm. It should be appreciated that the alignment arms 62 can have any cross-sectional shape as desired.

Figure 3E:
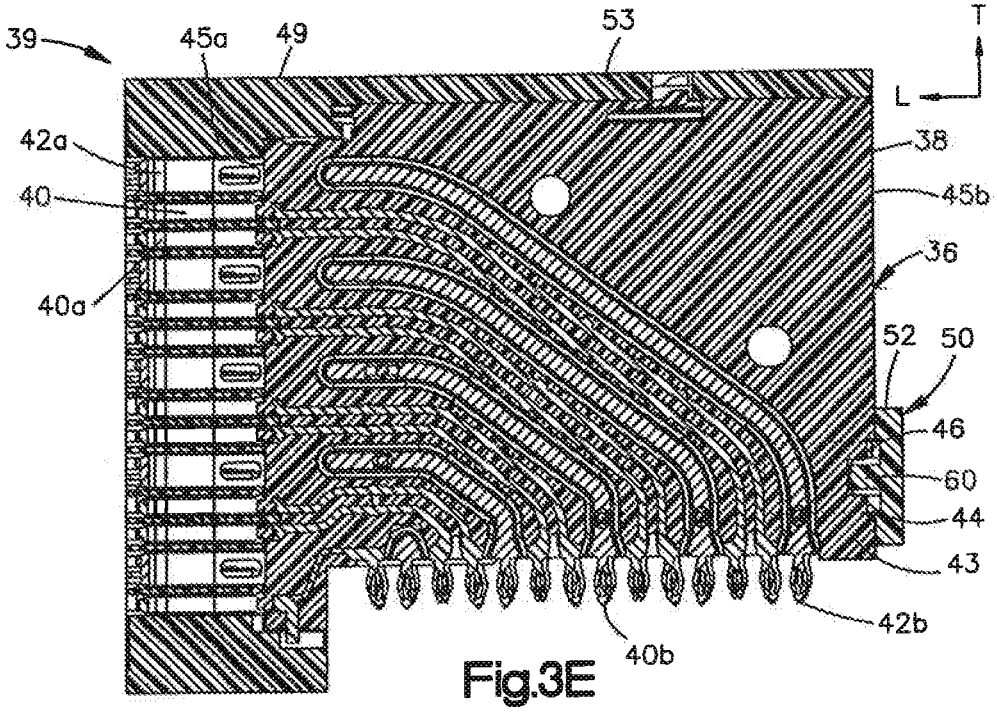
FIG. 3E is a sectional side elevation view of an electrical connector including the organizer illustrated in FIG. 3A.
Figure 3F:
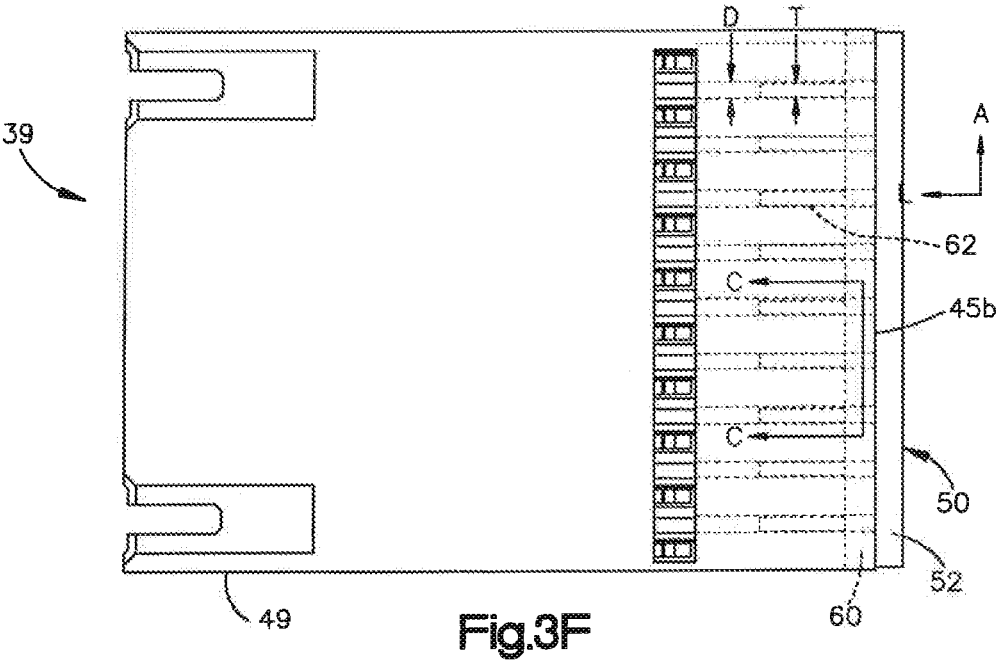
FIG. 3F is a top plan view of the electrical connector illustrated in FIG. 3E.
Figure 3G:
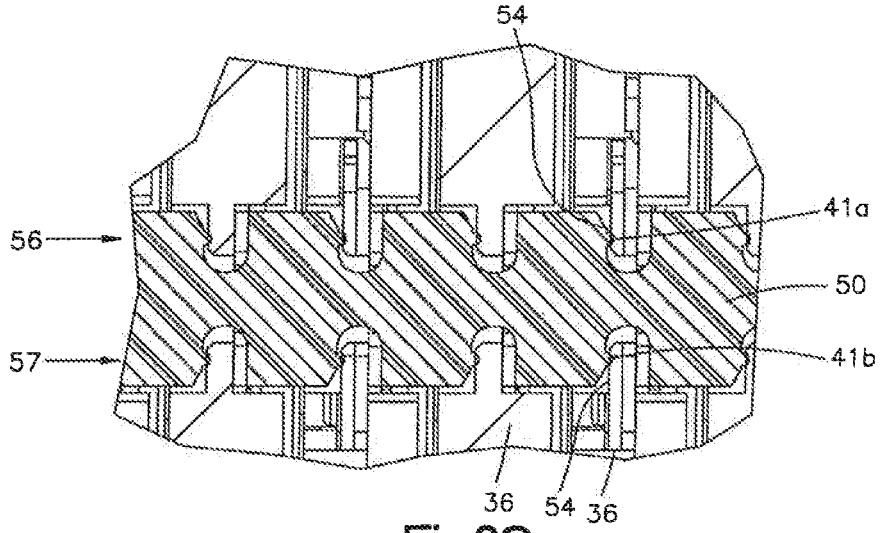
FIG. 3G is a sectional view through a portion of the organizer illustrated in FIG. 3F, taken along line C-C.

Referring now also to FIGS. 3E-3G, an electrical connector 39 can include an electrically insulative connector housing 49, and a plurality of leadframe assemblies 36 that is supported by the connector housing and adjacent each other along the lateral direction A. Each of the leadframe assemblies 36 can include an electrically insulative leadframe housing 38, and a plurality of electrical signal contacts 40 supported by the leadframe housing 38. The signal contacts 40 can each define a respective mating end 40*a* and a respective mounting end 40*b*. The mating ends 40*a* can extend out from a front end 45*a* of the respective leadframe assemblies 36. The mating ends 40*a* and the mounting ends 40*b* can be oriented perpendicular to each other, such that the signal contacts 40 are right-angle signal contacts, and the electrical connector 39 is a right-angle electrical connector. Alternatively, the mating ends 40*a* and the mounting ends 40*b* can be oriented parallel to each other, such that the signal contacts 40 are configured as vertical signal contacts, and the electrical connector 39 is configured as a vertical connector.

Figure 1:
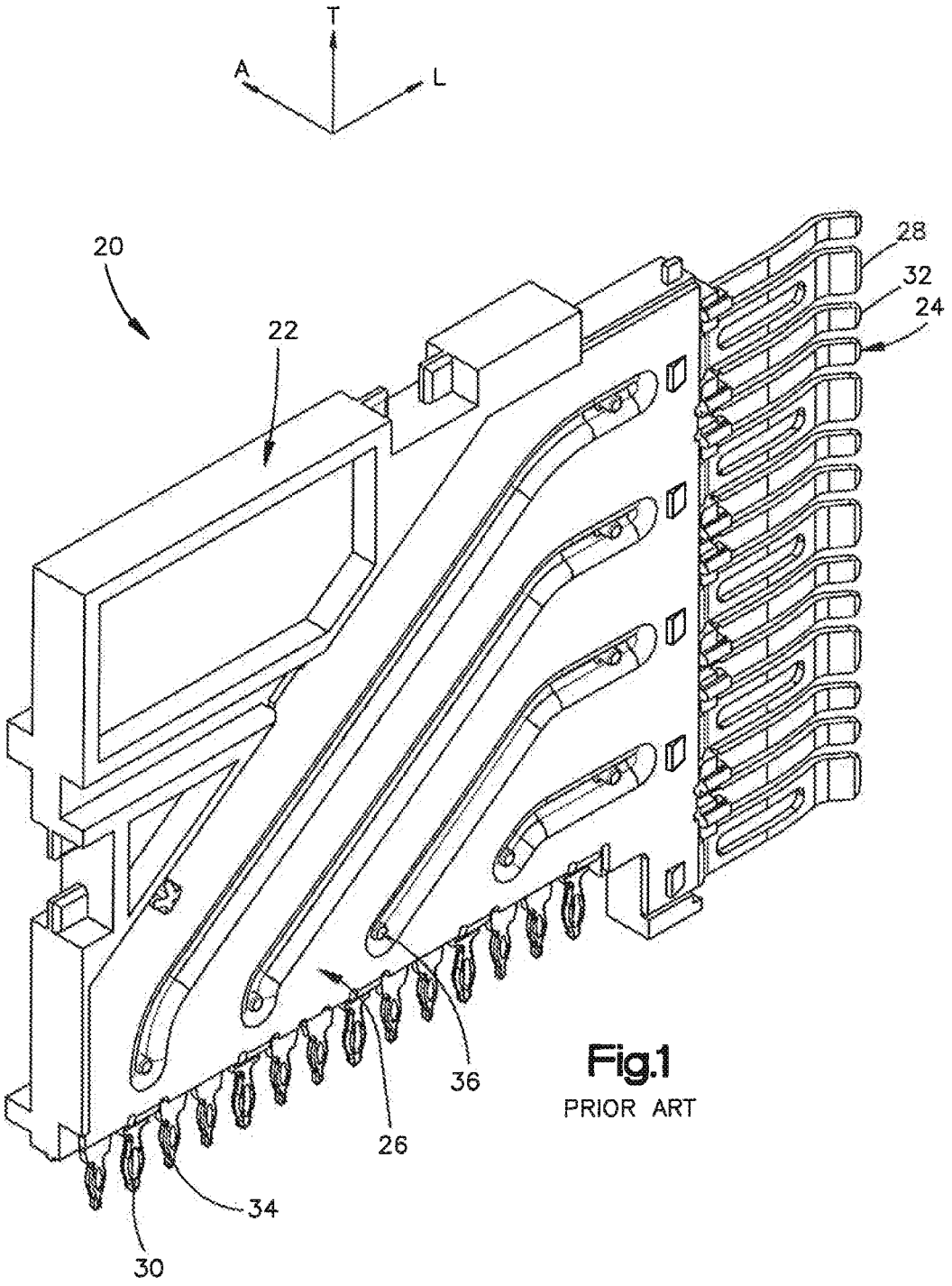
Fig.1 PRIOR ART
FIG. 1 is a perspective view of a leadframe assembly constructed in accordance with the prior art.

Each of the leadframe assemblies 36 can further include an electrically conductive ground plate that is supported by the leadframe housing 38 in the manner illustrated in FIG. 1. The ground plate defines a plurality of ground mating ends 42*a* and ground mounting ends 42*b*. Alternatively, the leadframe assemblies 20 can include discrete ground contacts that are separated from each other and each define their own separate mating ends and mounting ends. The ground mating ends 42*a* can extend out from the front end 45*a* of the respective leadframe assemblies 36. The ground mating ends 42*a* can be aligned with the mating ends 40*a* of the signal contacts 40 along the transverse direction T. The ground mounting ends 42*b* can be aligned with the mounting ends 40*b* of the signal contacts 40 along the longitudinal direction L. The electrical connector 39 can define a mounting interface 43, such that the mounting ends 40*b* of the signal contacts 40 and the ground mounting ends 42*b* extend from the mounting interface 43. The mounting interface 43 is configured to face an underlying substrate, such as a printed circuit hoard, to which the electrical connector 39 is mounted or configured to be mounted.

Adjacent ones of the leadframe assemblies 36 can be spaced apart a distance along the lateral direction A that is equal to the thickness of the alignment arms 62 along the lateral direction A. The alignment arms 62 can bear against respective adjacent ones of the leadframe assemblies 36 so as to maintain the spacing of the leadframe assemblies 36 from each other at the distance D.

The electrical connector 39 can further include the organizer 50 that is inserted into a channel 44 defined by apertures 46 of each of the leadframe assemblies 36. Thus, the apertures 46 of each of the leadframe assemblies 36 can be substantially aligned with each other along the lateral direction A so as to define the channel 44. For instance, the apertures 46 can be defined in a rear end 45*b* of the leadframe assemblies 36 that is opposite the front end 45*a*. In one example, the apertures 46 extend into the leadframe housings 38 in the forward direction. The channel 44, and thus the organizer 50, can be positioned adjacent the mounting interface 43. That is, the channel 44 can be disposed closer to the mounting interfaces 43 than upper surfaces 53 of the leadframe assemblies 36 that are opposite the mounting interfaces 43 along the transverse direction T. For instance, the channel 44 can be spaced from the mounting interface 43 a first distance, and spaced from the upper surface a second distance that is at least twice the first distance.

In one example, the channel 44 can be sized and shaped to receive the stiffener wall 58. In a further example, the rear surface 58*b* of the stiffener wall 58 can be inserted into the channel 44 or otherwise flush with the rear surfaces of the leadframe assemblies 36 that define the apertures 46 of the channel 44. At least a plurality of the alignment arms 62 of the organizer 50 can extend between adjacent ones of the leadframe assemblies 36. For instance, at least a plurality of the alignment arms 62 can extend to a location that is aligned with the ground plate of the adjacent ones of the leadframe assemblies 36 along the lateral direction A. In one example, the alignment arms 62 can be in contact with the ground plate. At least a portion up to an entirety of the apertures 46 can be defined by the leadframe housings 38, Further, a portion of the apertures 46 can be defined by the ground plate.

The leadframe assemblies 36 can define respective first retention walls 41*a* that are configured to be inserted into the respective ones of the grooves 54 of the first row 56. In one example, the first retention walls 41*a* can be sized to be press-fit into the grooves 54 of the first row 56 when the organizer is inserted into the channel 44. Further, the leadframe assemblies 36 can define respective second retention walls 41*b* that are configured to be inserted into the respective ones of the grooves 54 of the second row 57. In one example, the second retention walls 41*b* can be sized to be press-fit into the grooves 54 of the second row 57 when the organizer is inserted into the channel 44. The second retention walls 41*b* can be disposed between the first retention walls 41*a* and the mounting interface with respect to the transverse direction T. The first and second retention walls 41*a* and 41*b* can partially define the apertures 46 that, in turn, define the channel 44. As described above, the opposed surfaces 61 of the grooves 54 can be spaced apart a distance along the lateral direction A that is substantially equal to a thickness of the retention walls 41*a-b* along the lateral direction A so as to be press-fit into the respective ones of the grooves 54. Thus, physical interference with respect to one or both of the lateral direction A and the transverse direction T between the retention walls 41*a-b* and the organizer 50 can help limit or prevent movement of the leadframe assemblies 36 with respect to the organizer 50.

Figure 3H:
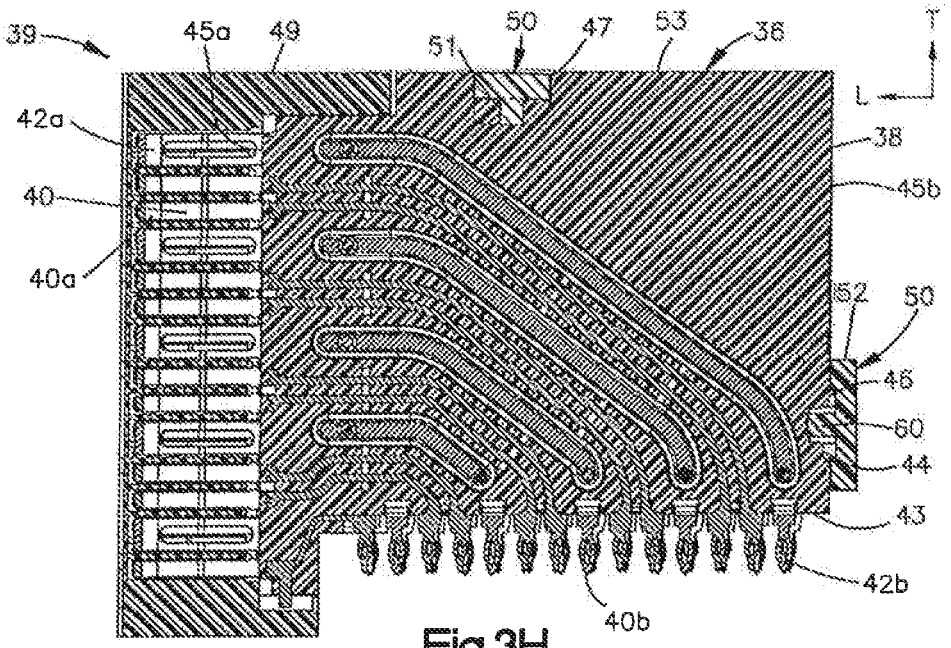
FIG. 3H is a sectional side elevation view of an electrical connector similar to the electrical connector illustrated in FIG. 3C, but including an upper organizer in accordance with an alternative embodiment.
Figure 4B:
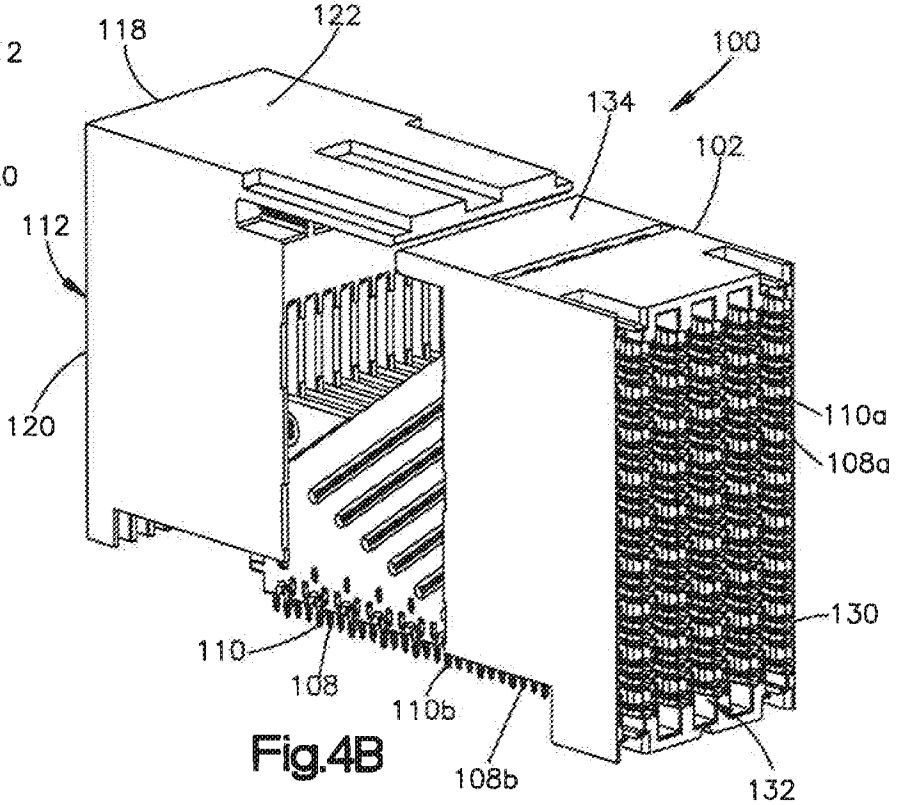
FIG. 4B is an exploded perspective view of the electrical connector illustrated in FIG. 4A.
Figure 4A:
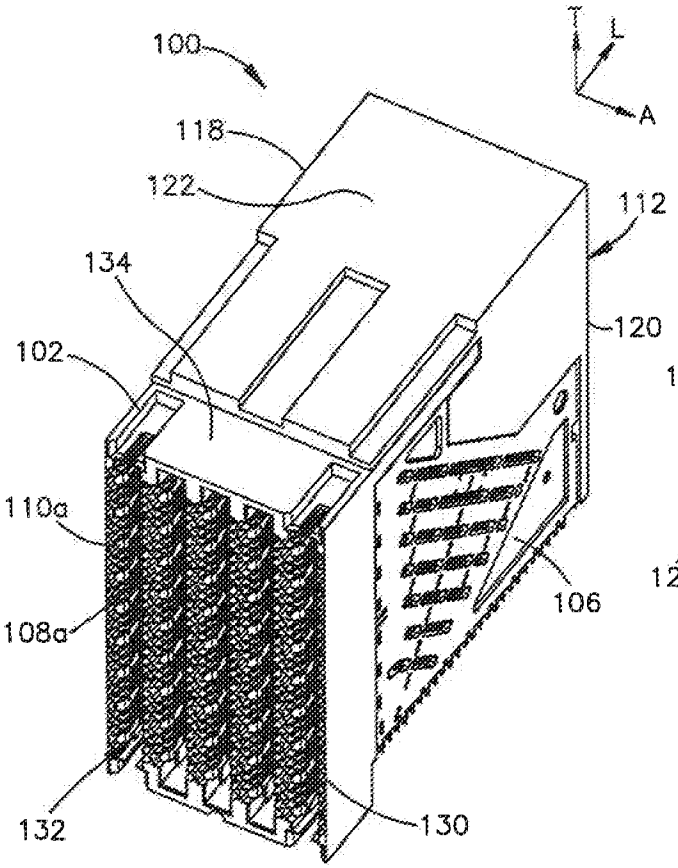
FIG. 4A is a perspective view of an electrical connector including an organizer constructed in accordance with another embodiment.
Figure 5B:
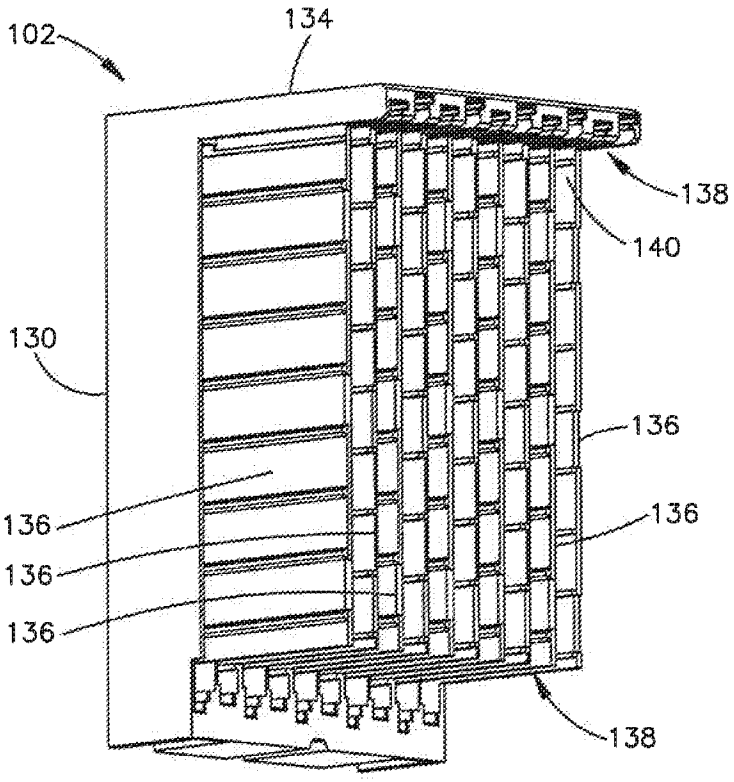
FIG. 5B is another perspective view of the connector housing illustrated in FIG. 5A.
Figure 5A:
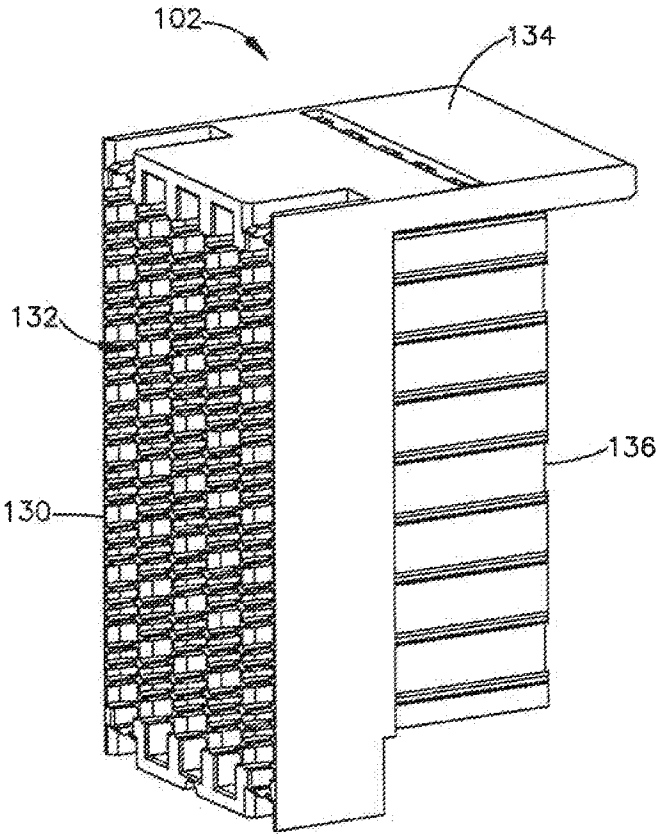
FIG. 5A is a perspective view of a connector lousing of the electrical connector illustrated in FIG. 4A.
Figure 7A:
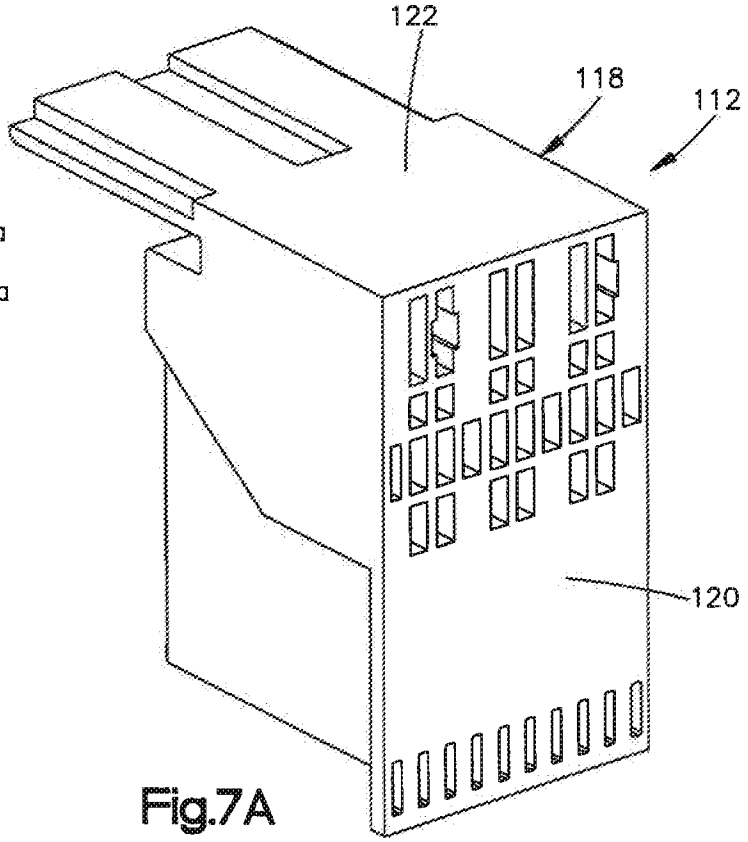
FIG. 7A is a perspective view of the organizer of the electrical connector illustrated in FIG. 4A.
Figure 6:
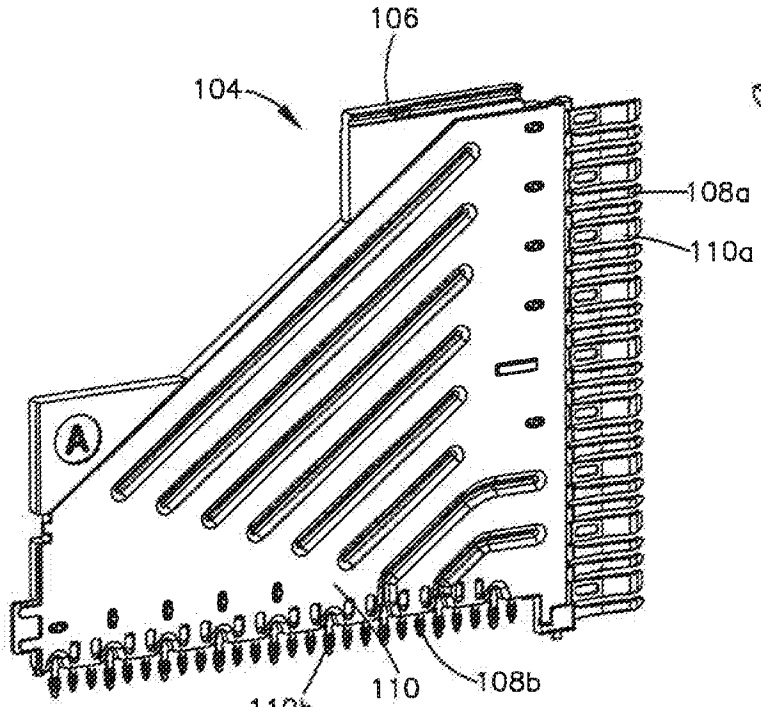
FIG. 6 is a perspective view of a leadframe assembly of the electrical connector illustrated in FIG. 4A.
Figure 7C:
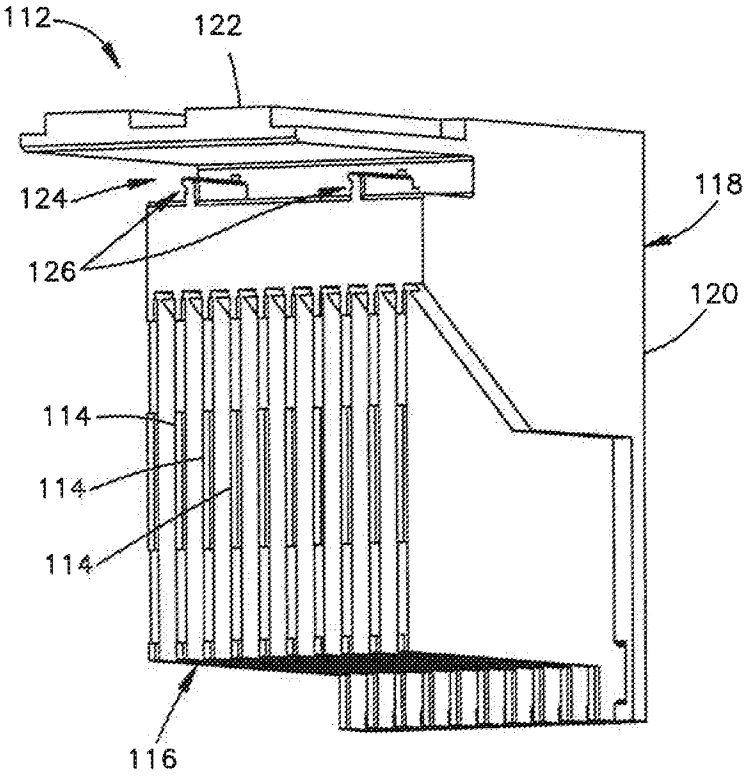
FIG. 7C is another perspective view of the organizer illustrated in FIG. 7A.
Figure 7B:
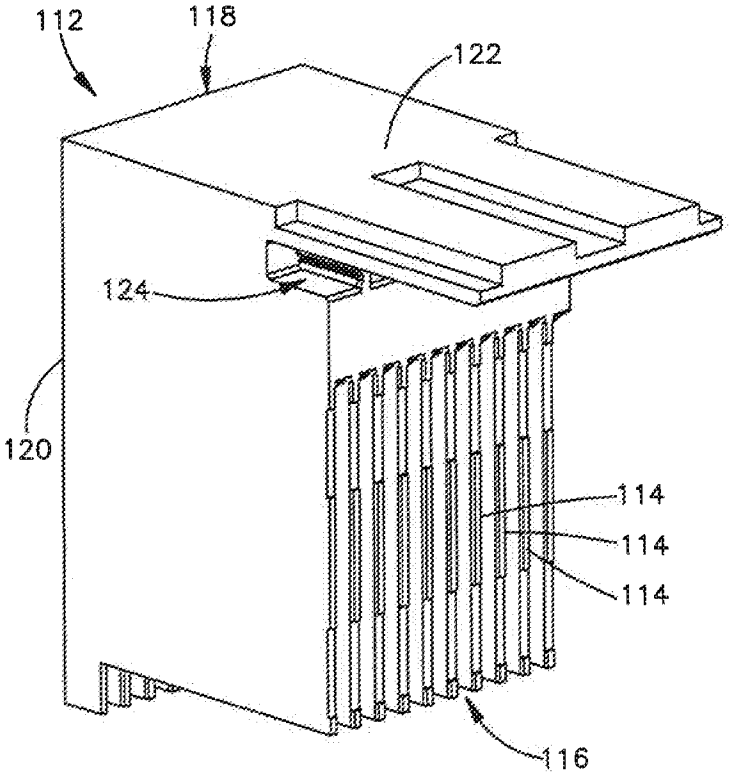
FIG. 7B is another perspective view of the organizer illustrated in FIG. 7A.
Figure 8A:
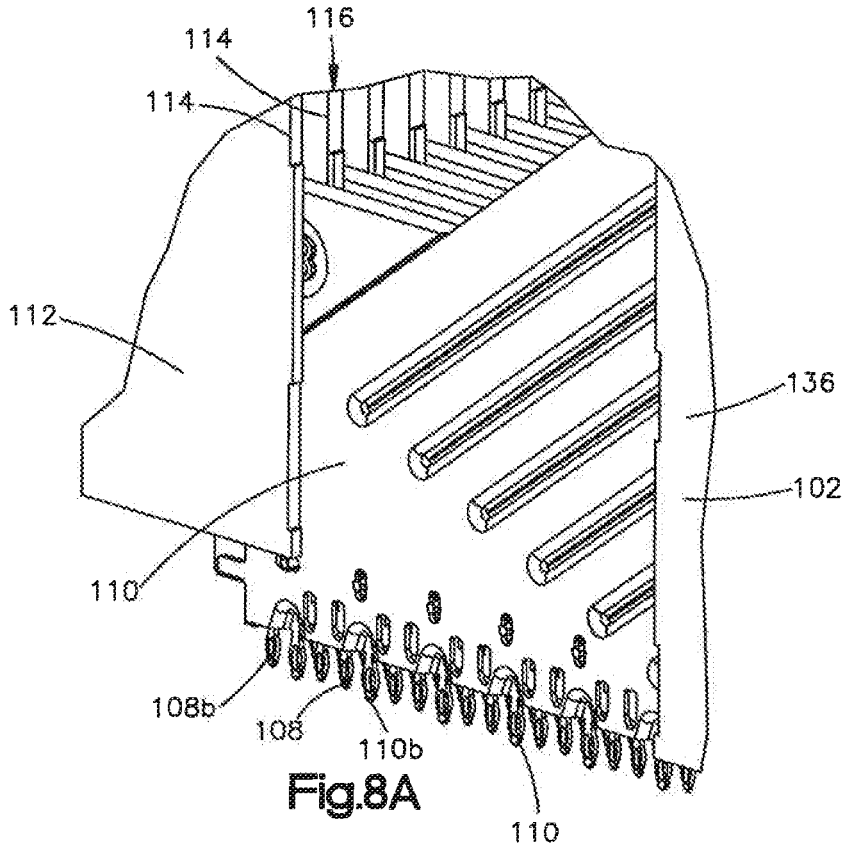
FIG. 8A is an enlarged exploded perspective view of a portion of the electrical connector illustrated in FIG. 4A.
Figure 8B:
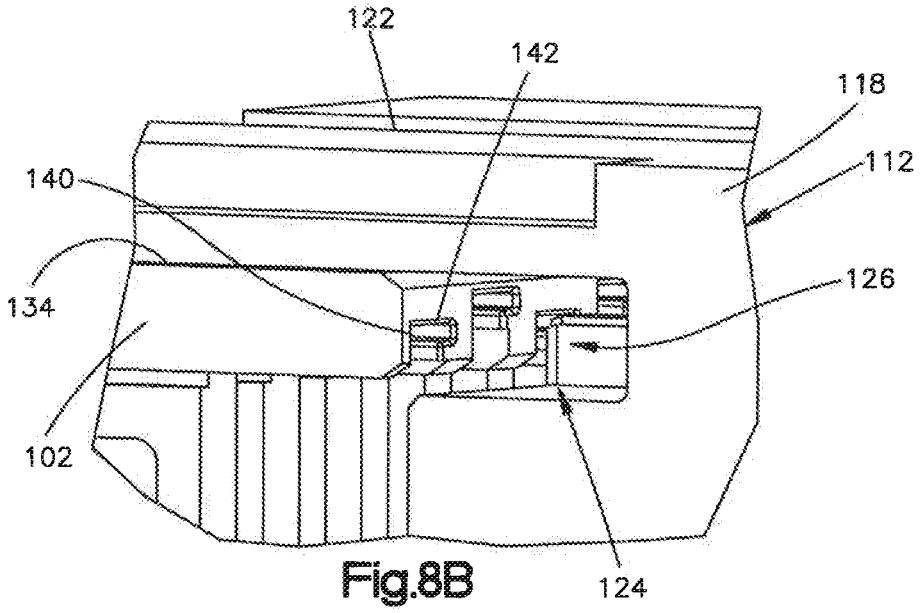
FIG. 8B is another enlarged exploded perspective view of a portion of the electrical connector illustrated in FIG. 4A.
Figure 9A:
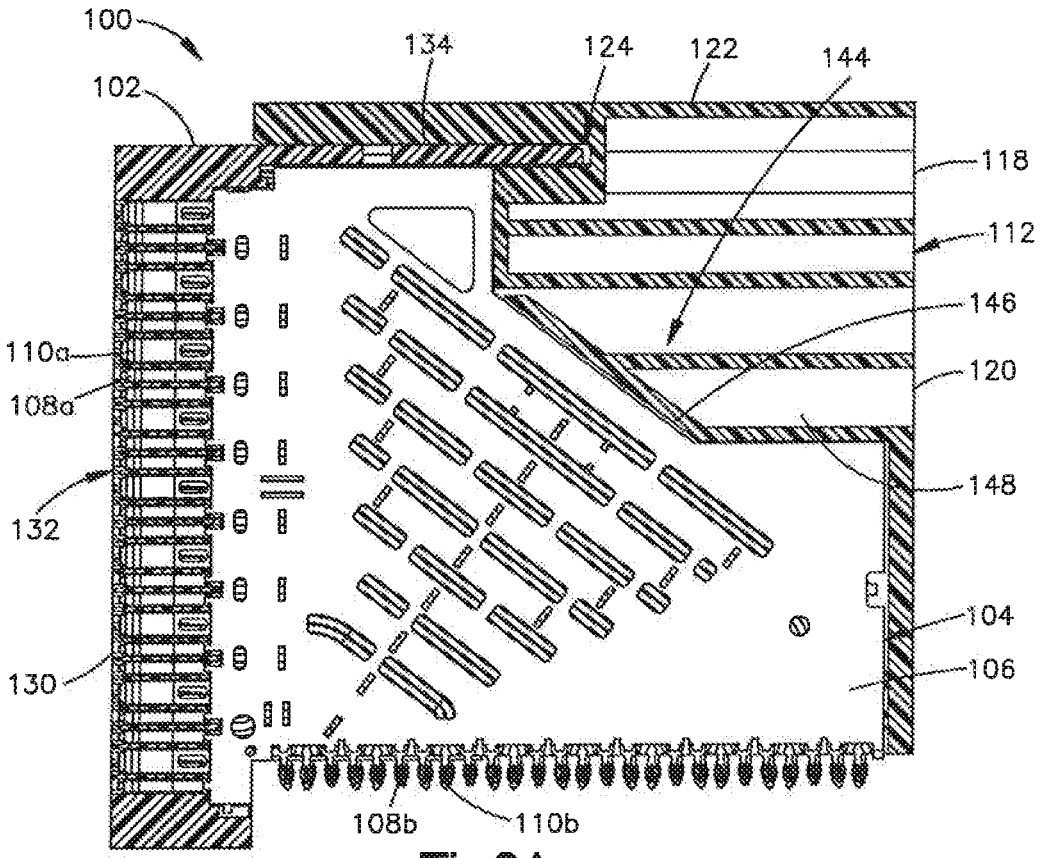
FIG. 9A is a sectional side elevation view of the electrical connector illustrated in FIG. 4A.
Figure 9B:
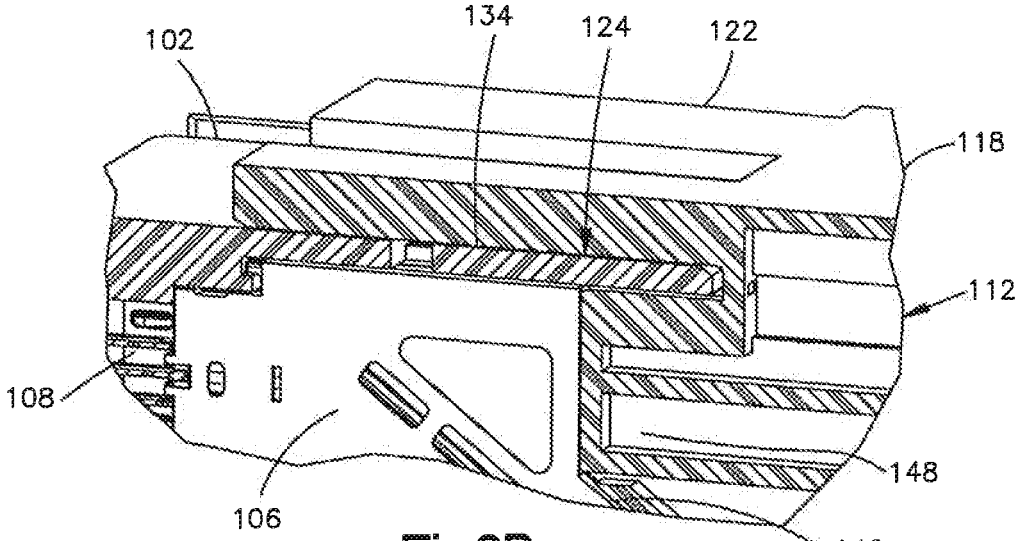
FIG. 9B is an enlarged portion of a sectional perspective view of the electrical connector illustrated in FIG. 4A.
Figure 10:
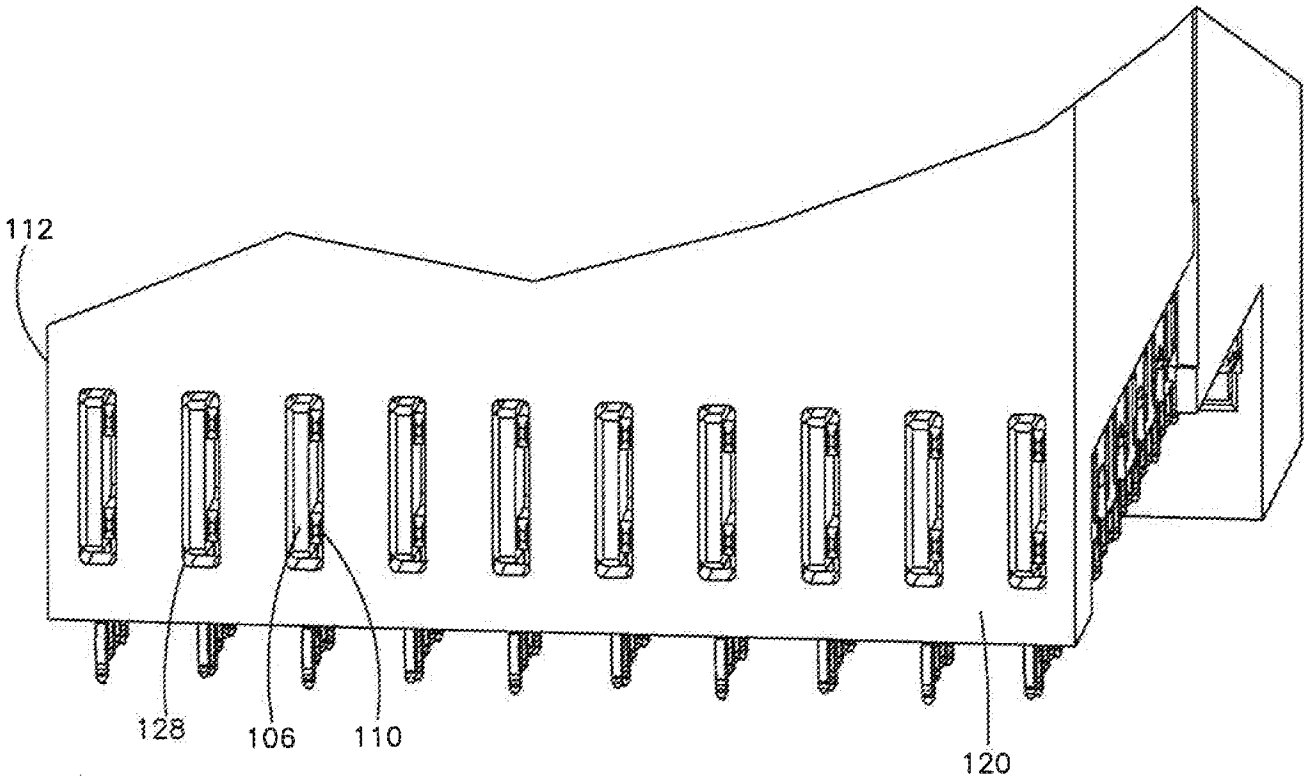
FIG. 10 is a perspective view of a rear end of the electrical connector illustrated in FIG. 4A.

In one example, the apertures 46 and the channel 44 defined by the rear end 45*b* of the leadframe assemblies 36 can be referred to as a first plurality of apertures 46 and a first channel 44. As illustrated in FIG. 3H, it should be appreciated that the electrical connector 39 can include a second plurality of apertures 51 and a second channel 47.

The electrical connector 39 can include a second one of the organizers 50 that is sized to be received in the second channel 47. As described above with respect to the apertures 46, each of the apertures 51 can be defined by a respective one of the leadframe assemblies 36. In particular, the apertures 51 can be defined by the upper surfaces 53 of the leadframe assemblies 36. As described above, the leadframe assemblies 36 can define first and second retention walls that partially define the apertures 51 that, in turn, define the channel 44. The first and second retention walls can be spaced from each other along the longitudinal direction. Further, the first and second rows 56 and 57 of a second one of the organizers 50 can be spaced along the longitudinal direction L when the second one of the organizers is disposed in the second channel 47.

It should be appreciated that a method can be provided for aligning the plurality of leadframe assemblies 36 of the electrical connector 39. The method can include the steps of supporting the leadframe assemblies 36 by the connector housing 49, and subsequently inserting the organizer 50 into the channel 44 of the electrical connector 39 in the manner described above.

Referring now to FIGS. 4A-10, an electrical connector 100 includes a dielectric or electrically insulative connector housing 102, and a plurality of leadframe assemblies 104 that are supported by the connector housing 102. The leadframe assemblies 104 can be spaced from each other along a lateral direction A when supported by the connector housing 102. Each of the leadframe assemblies 104 include an electrically insulative leadframe housing 106, a plurality of electrical signal contacts 108 supported by the leadframe housing 106, and an electrically conductive ground plate 110 supported by the leadframe housing 106. The electrical connector 100 further includes an electrically insulative organizer 112 that is configured to maintain alignment of the leadframe assemblies 104. The organizer 112 can include including a plurality of electrically insulative divider walls 114. The organizer 112 can define gaps 116 that are defined between adjacent ones of the divider walls 114. The organizer 112 is configured to be attached to the connector housing such that the leadframe assemblies 104 are inserted into respective ones of the gaps 116.

The electrical signal contacts 108 can define mating ends 108*a* and mounting ends 108*b*. Similarly, the ground plate 110 can define mating ends 110*a* and mounting ends 108*b*. The mating ends can be oriented perpendicular to the mounting ends, such that the electrical connector 100 can be configured as a right-angle electrical connector. Alternatively, the mating ends can be oriented parallel to the mounting ends, such that the electrical connector 100 can be configured as a vertical electrical connector.

The organizer 112 includes an electrically insulative body 118 that defines a rear wall 120, a top wall 122 that extends from an upper end of the rear wall in a forward direction that is oriented along a longitudinal direction L that is perpendicular to the lateral direction A. The divider walls 114 are supported by the organizer body 118. For instance, the divider walls 114 can be monolithic with the organizer body 118. Alternatively, the divider walls 114 can be separate from the organizer body 118 and attached to the organizer body 118 using any attachment mechanism as desired. The divider walls 114 are positioned to be inserted between adjacent ones of the leadframe assemblies 104. The organizer 112 can further define a channel 124 that extends into the organizer body 118 in a rearward direction opposite the forward direction. The organizer 112 can further include at least one alignment member 126 that extends from the organizer body 118 in to the channel 124. The at least one alignment member 126 of the organizer 112 can be configured to engage a complementary alignment member of the connector housing 102 when the organizer 112 is attached to the connector housing 102. The channel 124 can be disposed between the top wall 122 and the divider walls 114 with respect to a transverse direction T that is perpendicular to both the longitudinal direction L and the lateral direction A. The organizer body 118 defines a plurality of apertures 128 that extend through the rear wall 120 in the longitudinal direction L at a location aligned with respective ones of gaps 116 in the longitudinal direction L.

The connector housing 102 defines a front end 130 that defines mating interface 132, such that the mating ends 108*a* of the signal contacts 108 and the mating ends 110*a* of the ground plate 110 are disposed proximate to the mating interface 132. The connector housing 102 further includes a top wall 134 that extends from the front end 130 in the rearward direction. The top wall 122 of the organizer 112 and the top wall 134 of the connector housing 102 can be positioned such that the top wall 122 of the organizer 112 covers the top wall 134 of the connector housing 102 when the connector housing 102 and the organizer 112 are attached to each other. Further, when the connector housing 102 and the organizer 112 are attached to each other, a portion of the top wall 134 of the connector housing 102 extends out from the top wall 122 of the organizer 112 along the forward direction. A terminal end of the top wall 134 at the rear end of the top wall 134 can be inserted into the channel 124 when the connector housing 102 and the organizer 112 are attached to each other.

The connector housing 102 can further include a plurality of divider walls 136 that are spaced from each other in the lateral direction A. The connector housing 102 thus defines a plurality of channels 138 that extend between adjacent ones of the divider walls 136 in the lateral direction A. The channels 138 can be aligned with respective ones of the channels 124 of the organizer 112. Accordingly, respective ones of the leadframe assemblies 104 can be disposed in aligned ones of the channels 124 and 138 of the organizer 112 and the connector housing 102, respectively. The channels 138 can further extend into a bottom end of the top wall 134.

The connector housing 102 can further define at least one complementary alignment member 140 that is configured to engage the respective at least one alignment member 126 of the organizer 112 when the organizer 112 is attached to the connector housing 102. For instance, the at least one alignment member 140 can be configured as a channel 142 that is defined by the top wall 134. Thus, the alignment member 140 can be configured to receive the alignment member 126. Alternatively, the alignment member 126 can be configured to receive the alignment member 140.

The top walls 112 and 134 can abut each other, such that a downward force applied to the top wall 122 of the organizer in the downward direction is transferred to the connector housing 102. The downward force applied to the top wall 122 of the organizer 112 can therefore be sufficient to insert the mounting ends 108*b* and 110*b* into respective apertures of the underlying substrate.

The leadframe housings 106 can define a plurality of cutouts 144 that are defined by an upper end 146 of respective ones of the leadframe housing 106. The portions of the upper ends 146 of the leadframe housings 106 that define the cutouts 144 can be aligned with a portion of an upper end of the ground plates 110 of the respective leadframe assemblies 104 in the lateral direction A. The organizer 112, and in particular the organizer body 118 can include a plurality of base walls 148 that are aligned with the channels 124, and thus aligned with respective ones of the gaps 116 in the longitudinal direction. Accordingly, the base walls 148 can be inserted into respective ones of the cutouts 144.

The organizer body 118 can further include the plurality of apertures 128 that extend through the rear wall 120 in the longitudinal direction L. The apertures 128 can be disposed at a location that is aligned with respective ones of gaps 116 between adjacent ones of the divider walls 114. A portion of an aligned one of the leadframe assemblies 104 can extend at least into or through each of the apertures 128. For instance, the portion of the aligned ones of the leadframe assemblies 104 can include a portion of the leadframe housing 106 and a portion of the ground plate 110.

The foregoing description is provided for the purpose of explanation and is not to be construed as limiting the electrical connector. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the electrical connector is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the electrical connector as described herein, and changes may be made without departing from the spirit and scope of the electrical connector, for instance as set forth by the appended claims.

What is claimed:

1. An organizer configured to maintain alignment of a plurality of leadframe assemblies of an electrical connector, the organizer comprising:

an electrically insulative body comprising:

a stiffener wall comprising a front surface and a rear surface offset from the front surface in a longitudinal direction, a projection that extends from a central portion of the front surface of the stiffener wall in the longitudinal direction, and a plurality of grooves that extend into the projection and are spaced from each other in a lateral direction along a first row, wherein the electrically insulative body is configured to couple with the leadframe assemblies such that a first retention wall of each of the leadframes is received in a respective one of the grooves;

wherein the grooves of the first row of grooves extend into the projection in a transverse direction, and the electrically insulative body further comprises a second row of grooves that extend into the electrically insulative body in the transverse direction, wherein grooves of the second row of grooves are configured to couple with a respective second retention wall of each of the leadframes.

2. The organizer as recited in claim 1, wherein the stiffener wall has a thickness in the longitudinal direction between 0.2 mm and 2 mm.

3. The organizer as recited in claim 2, wherein the thickness of the stiffener wall is between approximately 0.4 mm and approximately 1 mm.

4. The organizer as recited in claim 1, further comprising a plurality of electrically insulative alignment arms that extend from the electrically insulative body.

5. An electrical connector comprising the organizer as recited in claim 1, wherein the connector further comprises:

an electrically insulative connector housing;

a plurality of leadframe assemblies supported by the connector housing and disposed adjacent to each other along a lateral direction, each of the leadframe assemblies including an electrically insulative leadframe housing and a plurality of signal contacts supported by the leadframe housing; and a channel, comprising respective apertures of the leadframe assemblies, configured to couple to the projection.

6. The organizer as recited in claim 1, wherein adjacent grooves of the grooves of the first row are spaced equidistantly from each other, and adjacent grooves of the grooves of the second row are spaced equidistantly from each other.

7. The organizer as recited in claim 6, wherein the grooves of the first row extend into the projection in a first direction that is oriented along the transverse direction, and the grooves of the second row extend into the projection in a second direction that is opposite the first direction.

8. The organizer as recited in claim 4, wherein each of the alignment arms extends from the projection at a location adjacent to at least one of the grooves.

9. The electrical connector as recited in claim 5, further comprising a plurality of electrically insulative alignment arms extending from the electrically insulative body between adjacent ones of the leadframe assemblies.

10. The electrical connector as recited in claim 9, wherein each of the leadframe assemblies includes an electrically conductive ground plate having ground mating ends that are aligned with the mating ends of the signal contacts of the respective leadframe assembly, wherein the at least a portion of the plurality of the arms extend to a location aligned with the ground plate along the lateral direction.

11. The electrical connector as recited in claim 5, further comprising a mounting interface, wherein mounting ends of the signal contacts extend from the mounting interface and the organizer is positioned adjacent the mounting interface.

12. An electrical connector comprising:

a connector housing;

a plurality of leadframe assemblies supported by the connector housing and spaced from each other along a first direction, each of the leadframe assemblies including:

an electrically insulative leadframe housing;

a plurality of electrical signal contacts supported by the leadframe housing; and an electrically conductive ground plate supported by the leadframe housing; and an electrically insulative organizer, comprising:

an electrically insulative body, comprising:

a plurality of grooves extending into the electrically insulative body and positioned along the first direction in alignment with respective ones of the plurality of leadframe assemblies, wherein the plurality of grooves comprise a first row of grooves spaced from a second row of grooves in a second direction perpendicular to the first direction; and a plurality of alignment arms extending from between adjacent ones of the plurality of grooves towards the plurality of leadframe assemblies with a plurality of gaps positioned between adjacent ones of the plurality of alignment members, wherein the plurality of leadframe assemblies are disposed in respective ones of the plurality of gaps.

13. The electrical connector as recited in claim 12, wherein the electrically insulative body comprises:

a wall; and a projection extending from the wall towards the plurality of leadframe assemblies and having the plurality of grooves, wherein the plurality of grooves extend into the projection along the second direction.

14. The electrical connector as recited in claim 12, wherein the plurality of alignment arms each comprise a primary wall and secondary walls that extend out from opposed ends of the primary wall.

15. The electrical connector as recited in claim 12, wherein the connector housing defines a mating interface, and mating ends of the signal contacts and the ground plate are disposed proximate to the mating interface.

16. The electrical connector as recited in claim 12, wherein the electrically insulative body comprises:

a projection, wherein the plurality of grooves extend into the projection, and the plurality of alignment arms attach to the projection between the adjacent ones of the plurality of grooves.

17. The electrical connector as recited in claim 13, wherein the plurality of alignment arms extend from the wall of the electrically insulative body towards the plurality of leadframe assemblies.

18. The electrical connector as recited in claim 17, wherein:

grooves of the first row of grooves extend into the projection in a direction opposite the direction in which grooves of the second row of grooves extend into the projection.

19. The electrical connector as recited in claim 13, wherein:

the plurality of alignment arms each comprise a first proximal end at a first edge of the projection spaced along the second direction from a second proximal end at a second edge of the projection.

20. An electrical connector, comprising:

a connector housing;

a plurality of leadframe assemblies supported by the connector housing and spaced from each other along a lateral direction, each of the leadframe assemblies including an electrically insulative leadframe housing, a plurality of electrical signal contacts supported by the leadframe housing, and an electrically conductive ground plate supported by the leadframe housing; and an electrically insulative organizer comprising a plurality of divider walls with respective gaps therebetween, wherein the organizer is configured to be attached to the connector housing such that the leadframe assemblies are inserted into respective ones of the gaps;

wherein the connector housing comprises a plurality of divider walls spaced in the lateral direction with gaps therebetween, the gaps being configured to align with respective ones of the gaps of the organizer, and the respective ones of the leadframe assemblies are disposed in respective pairs of aligned gaps of the gaps of the organizer and the connector housing.

* * * * *